United States Patent [19]

Thuries et al.

[11] Patent Number: 4,754,109

[45] Date of Patent: Jun. 28, 1988

[54] COMPRESSED DIELECTRIC GAS HIGH-TENSION CIRCUIT BREAKER

[75] Inventors: Edmond Thuries, Pusignan; Denis Dufournet, Bron, both of France; Satoru Yanabu, Tokyo, Japan; Michel Perret, Tramole, France

[73] Assignee: Alsthom, Paris, France

[21] Appl. No.: 32,677

[22] Filed: Apr. 1, 1987

[30] Foreign Application Priority Data

Apr. 1, 1986 [FR] France ..... 86 04606

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,649,243 3/1987 Thuries ..... 200/148 A 4,650,941 3/1987 Thuries et al. ..... 200/148 A 4,650,942 3/1987 Perret ..... 200/148 A

*Primary Examiner*—Robert S. Macon

*Attorney, Agent, or Firm*—Sughrue, Mion, Zinn, Macpeak, and Seas

[57] ABSTRACT

A compressed dielectric gas high-tension circuit breaker comprising: a fixed assembly comprising main contacts and arcing contacts; a moving assembly comprising main contacts and arcing contacts; a blast chamber comprising a piston which moves on separation of the contacts to urge compressed blast gas towards a blast nozzle situated in the zone where an arc is struck; and a thermal volume; wherein the thermal volume is in communication with the downstream portion of the blast nozzle via channels and passages extending the path between the thermal volume and said nozzle, said communication being closed by a calibrated non-return valve which opens only when the pressure in said channels and in said passage reaches a threshold value, said non-return valve closing the passage between the blast chamber and the nozzle when said communication is opened.

3 Claims, 4 Drawing Sheets

COMPRESSED DIELECTRIC GAS HIGH-TENSION CIRCUIT BREAKER

The present invention relates to a compressed dielectric gas circuit breaker of the type comprising a blast chamber and a thermal volume.

BACKGROUND OF THE INVENTION

In this type of apparatus, the blast chamber includes means such as a cylinder and a piston for compressing the gas during an opening or current-interrupting maneuver, and for directing the compressed gas through a blast nozzle onto the arc to be extinguished.

The term "thermal volume" is used to designate a volume opening out to a zone close to where an arc is struck when the circuit breaker opens.

The gas in this volume is heated by the arc, and as a result its pressure increases.

The energy accumulated in this way is generally used for contributing to the arc-blasting effect and/or for constituting additional energy for maneuvering the circuit breaker.

When the current to be interrupted is a low current (i.e. the nominal current or less), the arc is small and the thermal volume has a negligible effect on interrupting the arc, so the entire arc-interrupting effect is produced by the blast chamber.

In contrast, if the current to be interrupted is high (a short circuit-current) the arc is large and a considerable amount of energy is accumulated in the thermal volume.

In some prior art circuit breakers, the gas heated by the arc is applied directly to the arc that needs to be extinguished. Unfortunately, such recently-heated hot gas does not have the necessary dielectric qualities for being a good arc-extinguishing gas, and in particular it contains various impurities and some of its molecules are ionized.

An aim of the invention is to use the energy of the arc to direct a jet of cold gas onto the arc rather than a jet of polluted hot gas.

Use has sometimes been made of the arc-heated gas to thrust cold gas onto the arc by means of a piston. One aim of the invention is to thrust said cold gas without using mechanical means.

SUMMARY OF THE INVENTION

The present invention provides a compressed dielectric gas high-tension circuit breaker comprising:

a fixed assembly comprising main contacts and arcing contacts;

a moving assembly comprising main contacts and arcing contacts;

a blast chamber comprising a piston which moves on separation of the contacts to urge compressed blast gas towards a blast nozzle situated in the zone where an arc is struck; and a thermal volume;

wherein the thermal volume is in communication with the downstream portion of the blast nozzle via channels and passages extending the path between the thermal volume and said nozzle, said communication being closed by a calibrated non-return valve which opens only when the pressure in said channels and in said passage reaches a threshold value, said non-return valve closing the passage between the blast chamber and the nozzle when said communication is opened.

BRIEF DESCRIPTION OF THE DRAWINGS

An embodiment of the invention is described by way of example with reference to the accompanying drawings, in which.

MORE DETAILED DESCRIPTION

Figure 1:
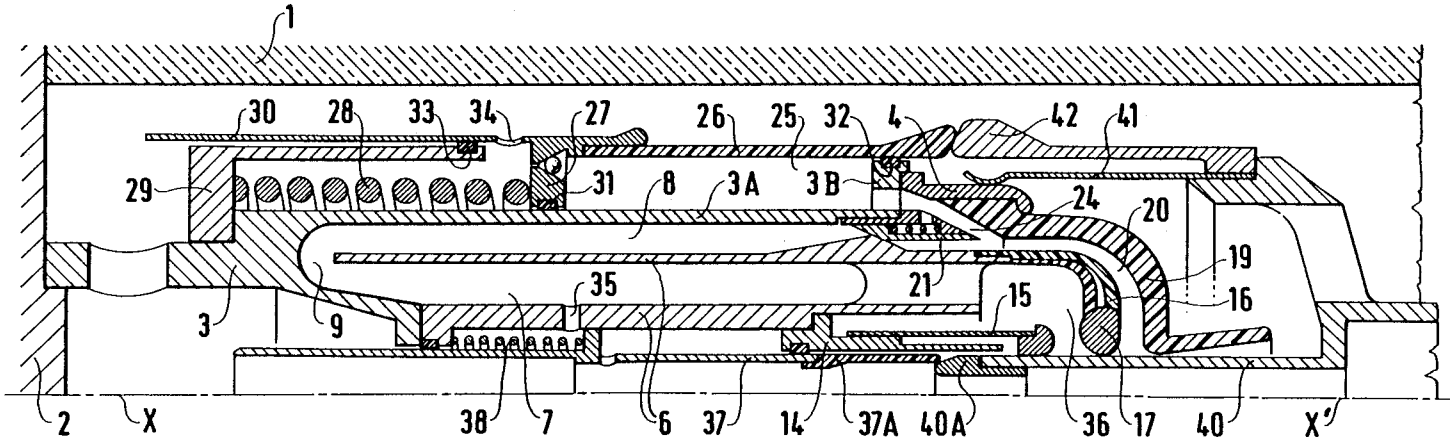
FIG. 1 is a fragmentary diagrammatic axial section through the current-interrupting chamber of a circuit breaker in accordance with the invention, shown in its closed position.
Figure 2:
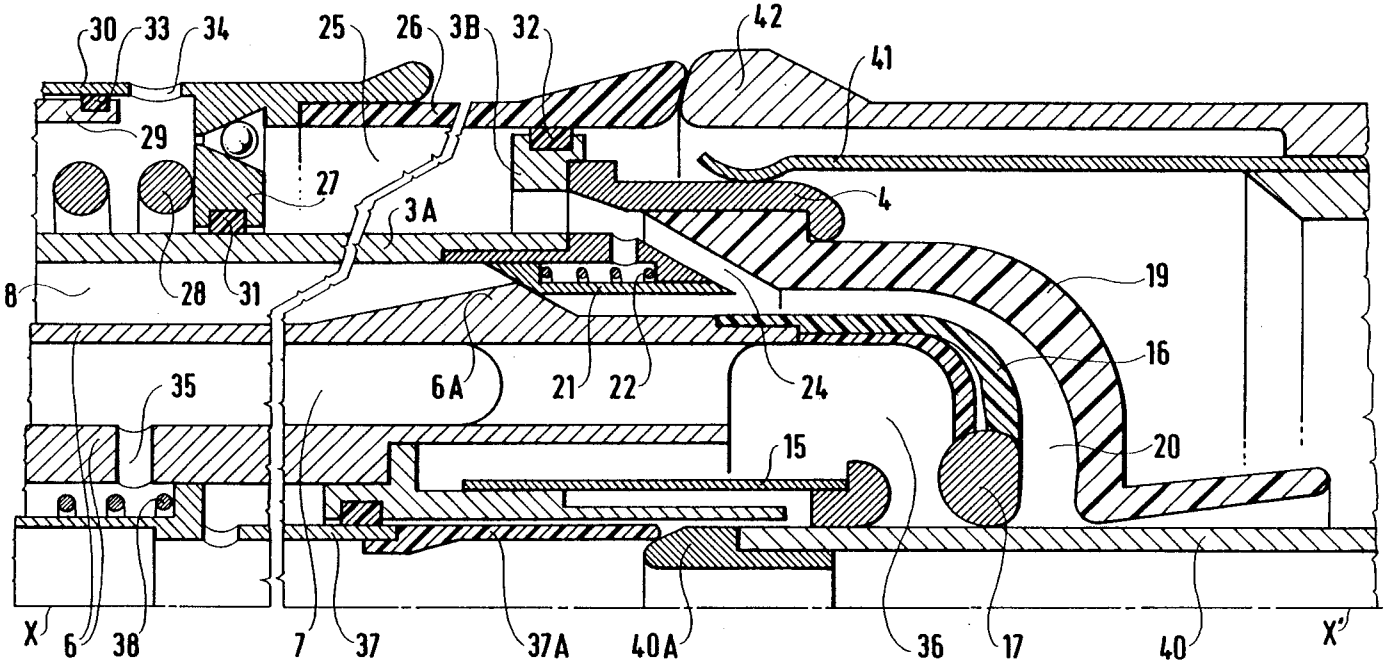
FIG. 2 is a view of a portion of FIG. 1 on a larger scale.

All of the figures are section views including the axis XX' of the circuit breaker, and all of the parts shown are circularly symmetrical about said axis.

The circuit breaker comprises an insulating envelope 1 and contains a dielectric gas such as sulfur hexafluoride at a pressure of a few bars.

The current-interrupting chamber includes a fixed assembly and a moving assembly. The fixed assembly comprises a metal block 2 connected to a current terminal of the circuit breaker (not shown). A part 3 is fixed to the block 2 and includes a tubular end portion 3A having a ring 4 disposed thereon to constitute the fixed main contact of the circuit breaker.

The part 3 is fixed to a cylindrical part having concentric cylinders 6 a channel such as 7 made through the thickness thereof and extending parallel to its axis.

The reference 8 designates the annular volume or channel lying between one of the cylinders 6 and tubular end portion 3A. The channel 7 communicates with the channel 8 via an annular volume 9 provided between the parts 3 and 6.

A tubular piece 14 is fixed on the inside of the end of the tube 6 and has a ring of arcing contact fingers 15 fixed thereto.

An insulating end fitting 16 is fixed on the outside of the end of the tube 6 and is terminated by an annular electrode 17 at a floating potential.

The fixed main contact is extended by an insulating nozzle 19 defining, together with the insulating and fitting 16, a passage 20.

The passage 20 communicates with the channel 8 via a moving non-return valve 21 coming into contact with a ridge 6A on the tube 6 under the action of a spring 22.

Under steady state conditions, with the circuit breaker either open or closed, communication between the channel 8 and the passage 20 is closed by the non-return valve 21.

The passage 20 also communicates, via a passage 24, with a blast chamber 25 which is delimited by an insulating cylinder 26, a semi-moving piston 27, and a ring 3B forming a portion of the part 3.

The piston moves under the action of a spring 28 disposed in a tubular housing 29.

The piston is extended by a guide cylinder 30.

Gaskets 31 and 32 seal the volume 25.

A ring 33 guides the cylinder 30.

References 34 and 35 designate pressure-equalizing holes.

The insulating part 16 and the FIG. 15 define a thermal volume 36 opening out into the zone where an arc is struck when the circuit breaker opens. When the circuit breaker is in the closed position, the thermal volume 36 is closed by the tubular end portion of the moving part 40 which constitutes the moving arcing contact.

As the circuit breaker opens, the thermal volume 36 remains closed by virtue of a sleeve 37 urged by a spring 38.

The sleeve 37 has an end 37A made of insulating material.

The tube 40 constituting the moving arcing contact is terminated by an end fitting 40A made of an alloy which withstands arc erosion well.

The moving portion of the current-interrupting chamber carries a set of permanent contact fingers 41 which co-operate with the contact or ring 4.

The fingers 41 are protected by an anti-corona discharge cap 42 which also serves as a pusher for the tube 26.

The moving assembly is connected via sliding contacts (not shown) to a circuit breaker terminal (not shown).

The circuit breaker operates as follows.

When the circuit breaker is closed (FIG. 1), current passes via the block 2, the cylinder 3, the contact 4, the fingers 41, and the moving part 40.

INTERRUPTING A LOW CURRENT (NOMINAL CURRENT OR CAPACITIVE CURRENT)

Figure 3A:
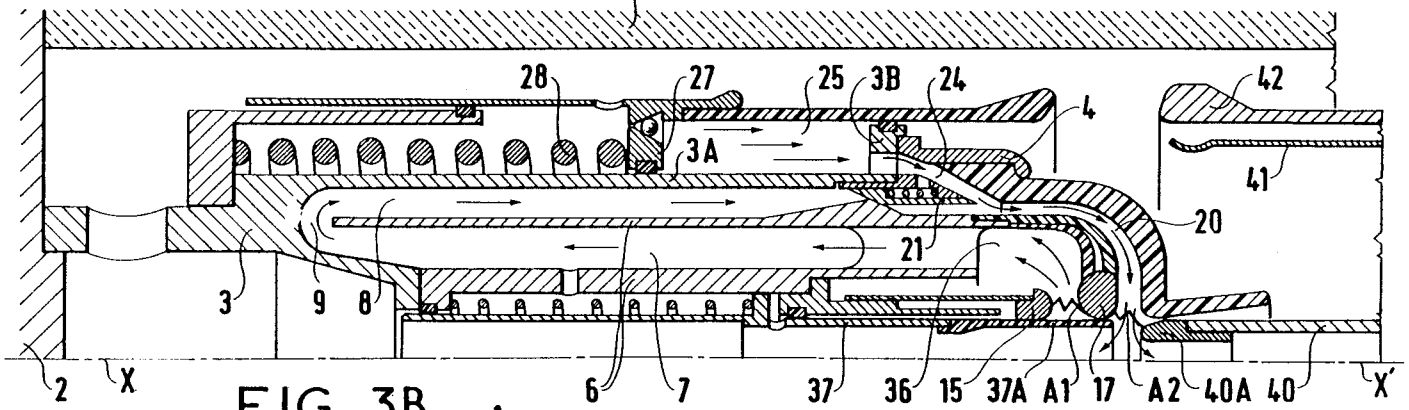
FIG. 3A is a fragmentary axial section through the same circuit-interrupting chamber in the middle of a circuit breaker opening maneuver for interrupting a low current.

Reference is made to FIG. 3A.

The arc A1 which is struck between the fingers 15 and the electrode 17 as the arcing contacts separate does not produce sufficient pressure increase in the thermal chamber 36 to displace the non-return valve 21.

The arc A2 which is struck between electrode 17 and the moving arcing contact 40 is interrupted by the jet of gas under pressure coming from the blast volume 25 via the passage 20.

INTERRUPTING HIGH CURRENTS (SHORT CIRCUIT CURRENTS)

Figure 3B:
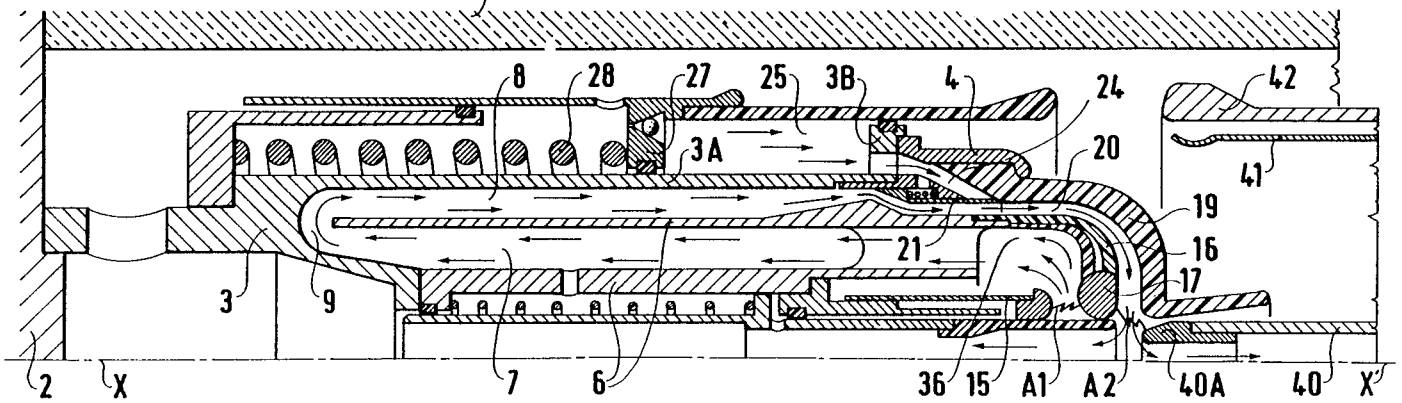
FIG. 3B is a fragmentary axial section through the same circuit-interrupting chamber in the middle of a circuit breaker opening maneuver for interrupting a high current.
Figure 4:
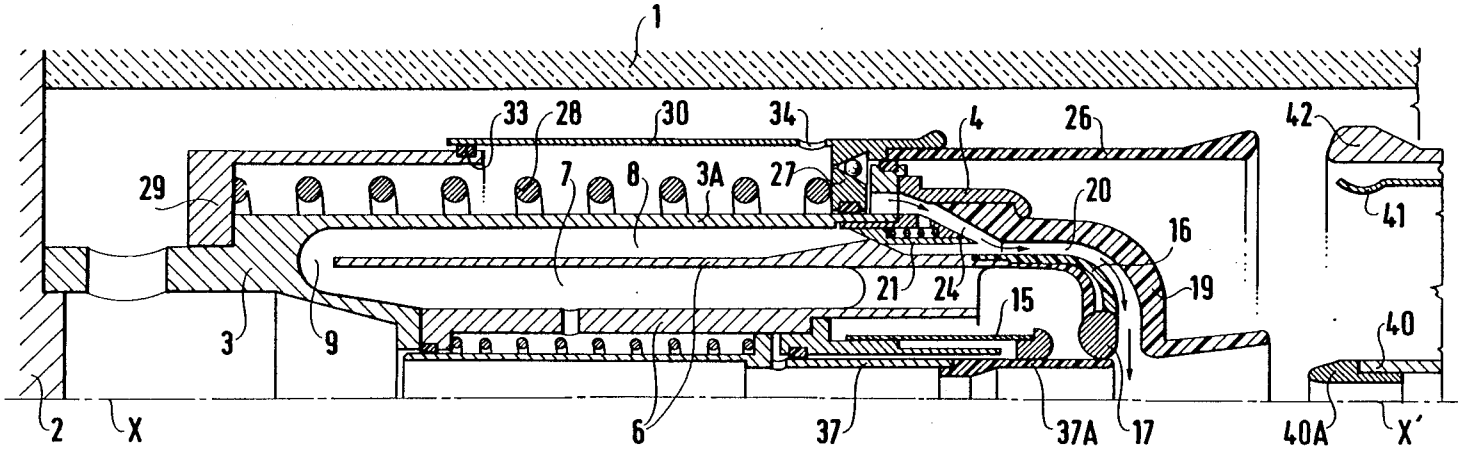
FIG. 4 is a fragmentary axial section through the same current-interrupting chamber shown in its end-of-stroke position.

Reference is made to FIG. 3B.

The pressure generated by the arc A1 is high enough to overcome the pressure of the spring 22 and the back pressure from the volume 25.

The valve 21 opens under the action of the gas contained in channels 8 under the thrust of pressure generated in the volume 36. The gas in the channel 8 is cold by virtue of the volume of gas within channel 7 7 which isolates the gas in the channel 8 from the thermal chamber 36.

The gas in the channel 8 flows via passage 20 to the blast nozzle 19 and interrupts the arc A2.

As soon as the arc A1 is extinguished, the pressure in the chamber 36 drops rapidly, thereby closing the non-return valve 21.

The cold compressed gas in the volume 25 can now escape via the passages 24 and 20 and thus ensure that proper dielectric performance of the apparatus is maintained.

The invention thus makes it possible to use the thermal energy of the arc under the best possible conditions.

The invention is applicable to high-tension circuit breakers.

We claim:

1. A compressed dielectric gas high-tension circuit breaker comprising:

a fixed assembly (2) comprising main contacts and arcing contacts;

a moving assembly (3) comprising main contacts and arcing contacts;

a blast chamber (25) comprising a piston (27) which moves on separation of the contacts to urge compressed blast gas towards a blast nozzle (19) situated in a zone where an arc is struck; and a thermal volume (36);

wherein the thermal volume (36) is in communication with the blast nozzle (19) via channels (7,8) and passage (20) defining an extended path between the thermal volume (36) and said nozzle (19); said channels (7,8) being closed by a calibrated non-return valve (21) which opens only when the pressure in said channels (7,8) and in said passage (20) reaches a threshold value, said non-return valve (21) simultaneously closing off communication between the blast chamber (25) and the nozzle (19) when said circuit breaker is opened.

2. A circuit breaker according to claim 1, wherein said nozzle includes a throat and said circuit breaker further includes an annular electrode disposed between said throat of the nozzle and ends of the fixed arcing contacts.

3. A circuit breaker according to claim 1, further including a semi-moving insulating sleeve for closing the thermal volume after the arcing contacts have separated.

* * * * *